United States Patent [19]

Ishii et al.

[11] Patent Number: 4,982,242

[45] Date of Patent: Jan. 1, 1991

[54] COLOR IMAGE FORMING APPARATUS

[75] Inventors: Yoshifumi Ishii, Daito; Masami Kai, Hirakata; Tetsuya Kagawa, Osaka; Masashi Matsumoto, Higashiosaka; Hideki Kita, Suita; Hiroyuki Deguchi, Osaka; Shoichi Kitagawa, Neyagawa, all of Japan

[73] Assignee: Mita Industrial Co., Ltd., Osaka, Japan

[21] Appl. No.: 412,145

[22] Filed: Sep. 25, 1989

[30] Foreign Application Priority Data

Sep. 30, 1988 [JP] Japan ..... 63-128724[U]

[51] Int. Cl.[5] ..... G03G 15/01

[52] U.S. Cl. ..... 355/326; 118/645; 355/260

[58] Field of Search ..... 355/326, 327, 245, 260; 206/316; 118/655-658, 645, 646, 647, 648

[56] References Cited

U.S. PATENT DOCUMENTS

| | | | |
|---|---|---|---|
| 4,601,259 | 7/1986 | Yamashita | 355/260 X |
| 4,841,329 | 6/1989 | Kasamura et al. | 355/326 X |
| 4,841,336 | 6/1989 | Kusumoto et al. | 355/326 X |
| 4,878,091 | 10/1989 | Morita et al. | 355/326 X |
| 4,896,184 | 1/1990 | Kamitamari et al. | 355/245 X |

FOREIGN PATENT DOCUMENTS

| | | | |
|---|---|---|---|
| 60-229045 | 11/1985 | Japan . | |
| 0138970 | 6/1986 | Japan | 355/260 |
| 61-149978 | 11/1986 | Japan . | |
| 62-143070 | 12/1987 | Japan . | |

*Primary Examiner*—Fred L. Braun
*Assistant Examiner*—J. E. Barlow, Jr.
*Attorney, Agent, or Firm*—Beveridge, DeGrandi & Weilacher

[57] ABSTRACT

A color image forming apparatus provided with a developing device for developing an electrostatic latent image formed on a latent image bearing member. The developing device comprises a plurality of developing units and supporting members for supporting the developing units thereon, and an arrangement is such that any developing units can be installed detachably on any supporting members each other. Then, the developing units have a developer supplying mechanism for feeding a developer each, and a supplemental developer container can be connected to each developer supplying mechanism. Then, the supplemental developer container is connected to one developing unit, and the developing unit provided with the supplemental developer is installed on a predetermined supporting member. The remaining developing units free from the supplemental developer container are then installed on the remaining supporting members. Accordingly, by connecting the supplemental developer container to a developing unit of the color to be consumed relatively more than the others and installing such developing unit on a predetermined supporting member, the developer of a desired color can be contained highly satisfactorily without constructing the color image forming apparatus entirely in a large size.

11 Claims, 4 Drawing Sheets

COLOR IMAGE FORMING APPARATUS

BACKGROUND OF THE INVENTION

1. Field of the Invention

The present invention relates to a color image forming apparatus such as color electrophotographic copying apparatus, color printer or the like. More particularly, it is concerned with a color image forming apparatus including a developing device comprising a plurality of developing units, the developing units developing an electrostatic latent image formed on a latent image bearing member. In the invention, developing means of the color image forming apparatus is applicable not only to a full-color development but also to a two-color or multicolor development. However, a full-color copying apparatus will be exemplified in the following description.

2. Description of the Prior Art

The full-color copying apparatus normally has a developing device provided with developing units containing four kinds of developers, black, magenta, yellow and cyan each. However, documents are mostly printed in black, and hence the black developer is consumed considerably much as compared with those of other colors.

Meanwhile, each developing unit of the developing device is constructed to contain the developer equally in quantity, therefore the black developer must particularly be supplemented more frequently than those of the other colors, which is something that takes a great deal of time for operators to accomplish.

A prior art attempt to solve such disadvantages, features a color image forming apparatus having a developing device wherein a developing unit for containing a black developer is larger than those for containing other color developers. An arrangement of this sort is disclosed in Japanese Patent Laid-Open Publication No. 143070/87.

However, according to the prior art color image forming apparatus, users who use a developer of color other than black (e.g., magenta or yellow developer) more than the black developer will never be satisfied thereby.

On the other hand, if all the developing units are enlarged so as to each contain a large volume of developer, then the developing device gets large in size as a whole, and thus the color image forming apparatus becomes inevitably large.

SUMMARY OF THE INVENTION

An object of the invention is to provide a small-sized color image forming apparatus capable of increasing content of a desired color developer.

To attain the aforementioned object, the color image forming apparatus of the invention is constructed such that a developing device for developing an electrostatic latent image formed on a latent image bearing member comprises a plurality of developing units and supporting members for supporting the developing units thereon, and any of the developing units can be mounted detachably on any one of the supporting members. Then, each developing unit has a developer supplying mechanism for replenishing a developer, and a supplemental developer container can be connected detachably to each developer supplying mechanism. The supplemental developer container is connected to one developing unit, and the developing unit provided with the supplemental developer container is installed on a predetermined supporting member. Then, the remaining developing units without the supplemental developer container are installed on the remaining supporting members.

Accordingly, an operator connects the supplemental developer container to the developer supplying mechanism of the developing unit containing the color to be consumed relatively faster than the other colors. The developing unit with attached supplemental developer container is then installed on the predetermined supporting member. The developer of a desired and more frequently used color can be provided in sufficient quantity without having to enlarge the color image forming apparatus.

Further objects, features and advantages of the present invention will become apparent from the detailed description given hereinbelow and accompanying drawings, which are given by way of illustration only, and thus are not limitative of the present invention.

DETAILED DESCRIPTION OF PREFERRED EMBODIMENTS

Preferred embodiments of the invention will now be described with reference to the accompanying drawings.

Figure 1:
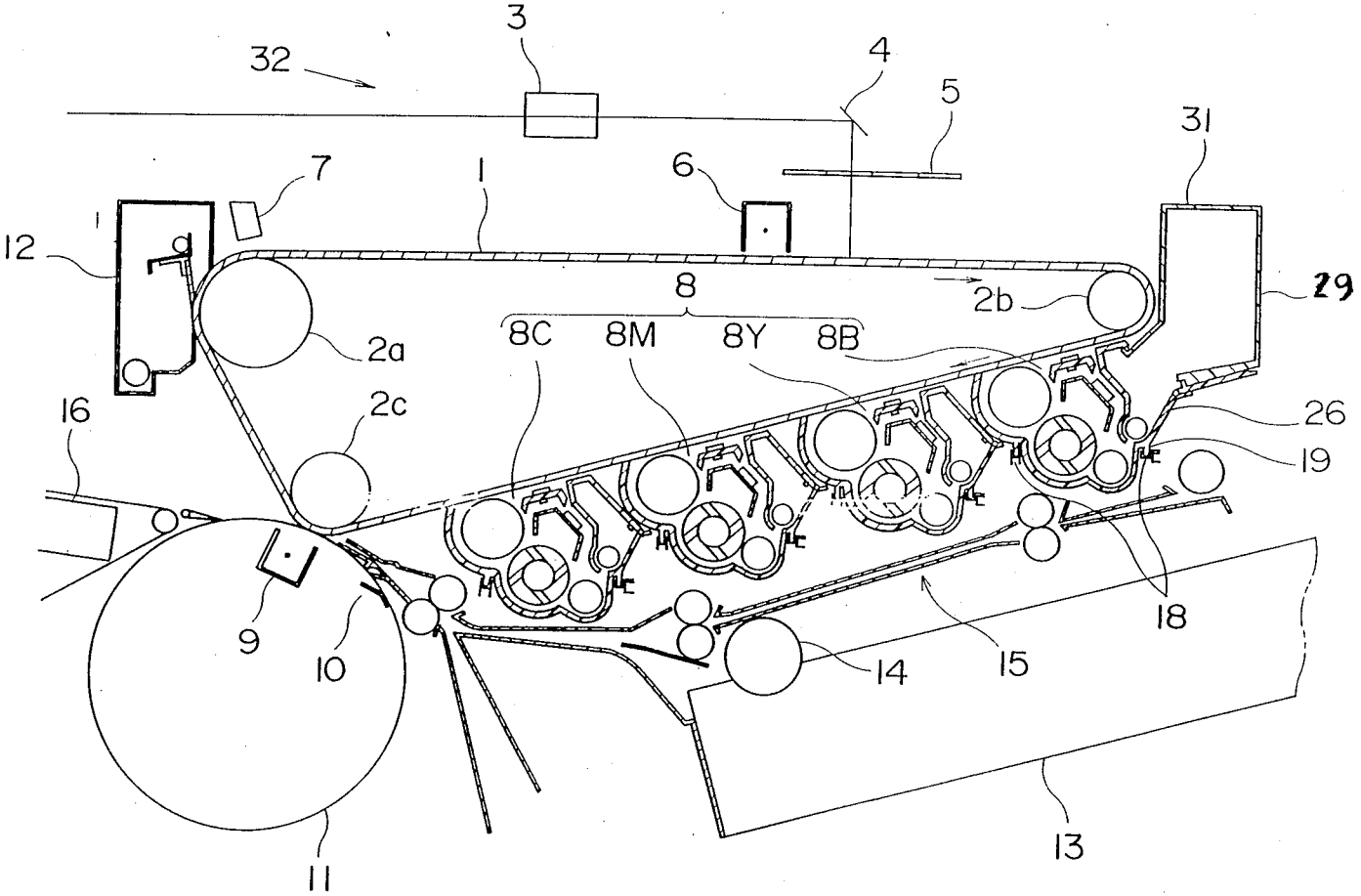
FIG. 1 is a sectional view representing a main part of a color image forming apparatus of the invention which includes a latent image bearing member and a developing device.
Figure 2:
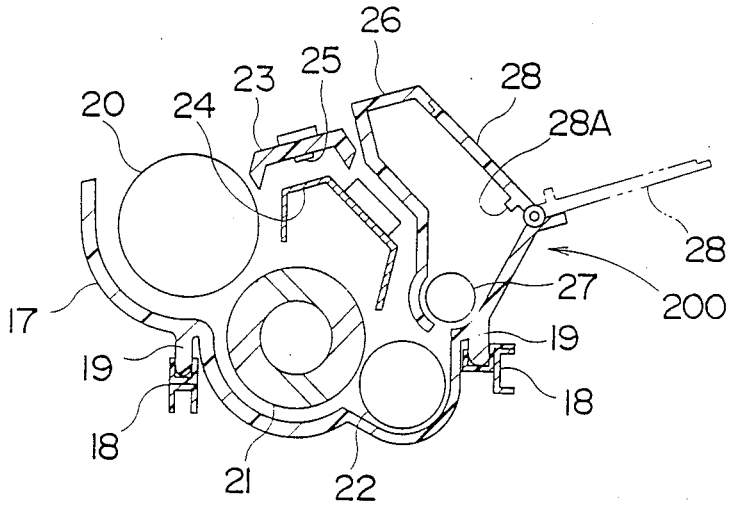
FIG. 2 is a sectional view representing one developing unit installed on a pair of supporting members in the developing unit of FIG. 1.
Figure 3:
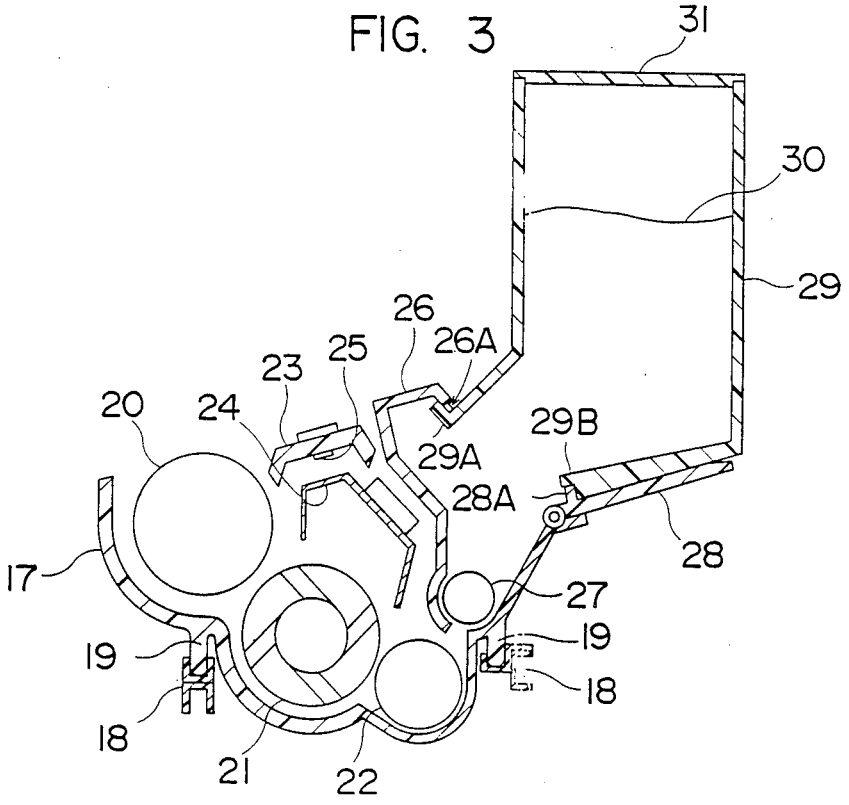
FIG. 3 is a sectional view representing a state wherein a supplemental developer container is connected to a developer supplying mechanism of the developing unit of FIG. 2.

FIG. 1 to FIG. 3 represent a first embodiment of the invention. Of those drawings, FIG. 1 represents a main part of a color image forming apparatus of the invention which includes a latent image bearing member and a developing device. FIG. 1 illustrates a photosensitive belt 1 as one example of the latent image bearing member provided, and the photosensitive belt 1 is laid over three rollers *2a, 2b, 2c* for rotation with a proper tension. An optical system 32 is provided over the photosensitive belt 1. In FIG. 1 a lens 3, a mirror 4 and a filter 5 which constitute a part of the optical system 32 are shown, and a light reflected on a document is introduced to the photosensitive belt 1 through the lens 3, the mirror 4 and the filter 5. Around the photosensitive belt 1, a main charger 6, a developing device 8 provided with four developing units 8B, 8Y, 8M, 8C, a transfer drum 11 provided with a transfer charger 9 and a gripper 10 for retaining a sheet thereon, a cleaning device 12, and a discharger 7 are provided in the direction where the photosensitive belt 1 rotates in that order.

Accordingly, the photosensitive belt 1 charged uniformly by the main charger 6 is exposed by the optical system 32, forms an electrostatic latent image thereon, and is then developed by the developing device 8. The image is then transferred to the sheet wound on the transfer drum 11 by the transfer charger 9. The process is repeated whenever each color image is formed, and in each image forming process a color of the filter 5 is changed, and the developing unit coordinating with the color of the filter 5 is actuated. A feed cassette 13 and a feed roller 14, a hand feed path 15 are provided on upstream side of the transfer drum 11 in the direction where the sheet is fed, and one of the sheets stacked in the feed cassette 13 or a sheet passing within hand feed path 15 is fed selectively to the transfer drum 11. A sheet feeding device 16 is provided on downstream side of the transfer drum 11 in the direction where the sheet is fed, and the sheet after transfer can be guided to a fixing device (not indicated).

Other than the developing units 8B, 8Y, 8M, 8C, the developing device 8 includes four pair of supporting members 18, 18 for supporting these thereon. Then, the four developing units 8B, 8Y, 8M, 8C contain developers black, yellow, magenta, cyan respectively. Further in the example, each of the four developing units 8B, 8Y, 8M, 8C has a common size and internal structure, and any developing units can be installed detachably on any pair of supporting members 18, 18 each other.

Next, one developing unit 8B will be taken up, by way of example, for description with reference to FIG. 2 and FIG. 3. Then, in the example, the developing unit 8B contains a two-component developer consisting of a toner and a carrier. However, the invention is not necessarily limited to the example, and a monocomponent developer may be used otherwise.

In FIG. 2, the developing unit 8B includes a developing case 17 and sliding projections 19, 19 are provided at proper positions ion the outside of the developing case 17. Sliding projections 19, 19 are engaged with supporting members 18, 18 which, in a preferred embodiment are a pair of rails. Sliding projections are slid vertically of the sheet surface such that developing case 17 is received by locking means (not shown) when installed properly. Developing case 17 and the locking means are arranged such that developing case 17 can be released and withdrawn from its installed position.

A developing roller 20 for applying a toner to the latent image formed on the photosensitive belt, a drawing-up roller 21 for feeding a developer to the developing roller 20, and a developer stirring member 22 for stirring a toner and a carrier are provided rotatably within the developing case 17. Further, a doctor blade 23 for regulating the height of a magnetic brush formed on the developing roller 20, and a divider 24 for returning the developer cut down by the doctor blade 23 to the developer stirring member 22 are provided within the developing case 17. Then, a toner density detection sensor 25 is provided on an upper wall portion of the developing case 17.

A developer supplying mechanism 200 is provided on a right upper portion of the developing case 17 so as to communicate with the developing case 17. The developer supplying mechanism 200 is provided with a toner hopper 26 having an opening below for communicating with the developing case 17, and a toner supplying toner 27 facing on the opening to feed a toner in the toner hopper 26 to the developing case 17. A cover 28 is provided which can be opened on an upper portion of the toner hopper 26, to enable insertion of toner hopper 26 through the cover 28. A salient 28A is formed on an inside of the cover 28, and thus when the cover 28 is kept open, a supplemental hopper 29 as the supplemental developer container can be connected detachably as shown in FIG. 3. That is, when the cover 28 is opened, one lower end 29A of the supplemental hopper 29 is locked to an opening end edge 26A of the toner hopper 26, and the other lower end 29B of the supplemental hopper 29 is locked to the salient 28A of the cover 28. Accordingly, the opening end edge 26A of the toner hopper 26 and the salient 28A of the cover 28 construct means for engaging with the supplemental hopper 29. Supplemental hopper 29, when connected to toner hopper 26, allows for the storage of a larger volume of toner 30. Cover 31 is provided closably on an upper portion of the supplemental hopper 29, thus toner can be fed to the supplemental hopper 29 and the toner hopper 29 through opened cover 31.

Thus, the supplemental hopper 29 is connected to the desired color developing unit of the four developing units 8B, 8Y, 8M, 8C, and the developing unit provided with the supplemetal hopper 29 is installed on predetermined supporting members. In FIG. 1, the predetermined supporting members are a pair of supporting members 18, 18 shown in the extreme right of FIG. 1. In the embodiment illustrated in FIG. 1; the four developing units 8B, 8Y, 8M, 8C are provided in rows, and there is a space provided over the developing unit which is to the right and above the predetermined supporting members so as to provide room for the predetermined developing unit and attached supplemental developer carrier. However, the position of the predetermined supporting members is not necessarily limitative, and if a space is produced at another position by the manner of arraying the developing units or the positional relation between the photosensitive belt 1 and a peripheral equipment of the photosensitive belt 1, then the developing unit provided with the supplemental hopper 29 may be installed on appropriately positioned predetermined supporting members. Then the remaining developing units (8Y, 8M, 8C in FIG. 1) are installed on the remaining supporting members 18, 18. Thus, the supplemental hopper 29 is connected to the desired color developing unit so as to provide storage for the required large volume of toner only in the developing unit of the one desired color. The space of the color image forming apparatus is thus utilized effectively, thereby allowing for a compact construction of the color image forming apparatus as a whole. Each developing unit can also be installed detachably on any supporting members, therefore any user's requirement can be satisfied even if there are different users relying more heavily on different developer colors.

Figure 4:
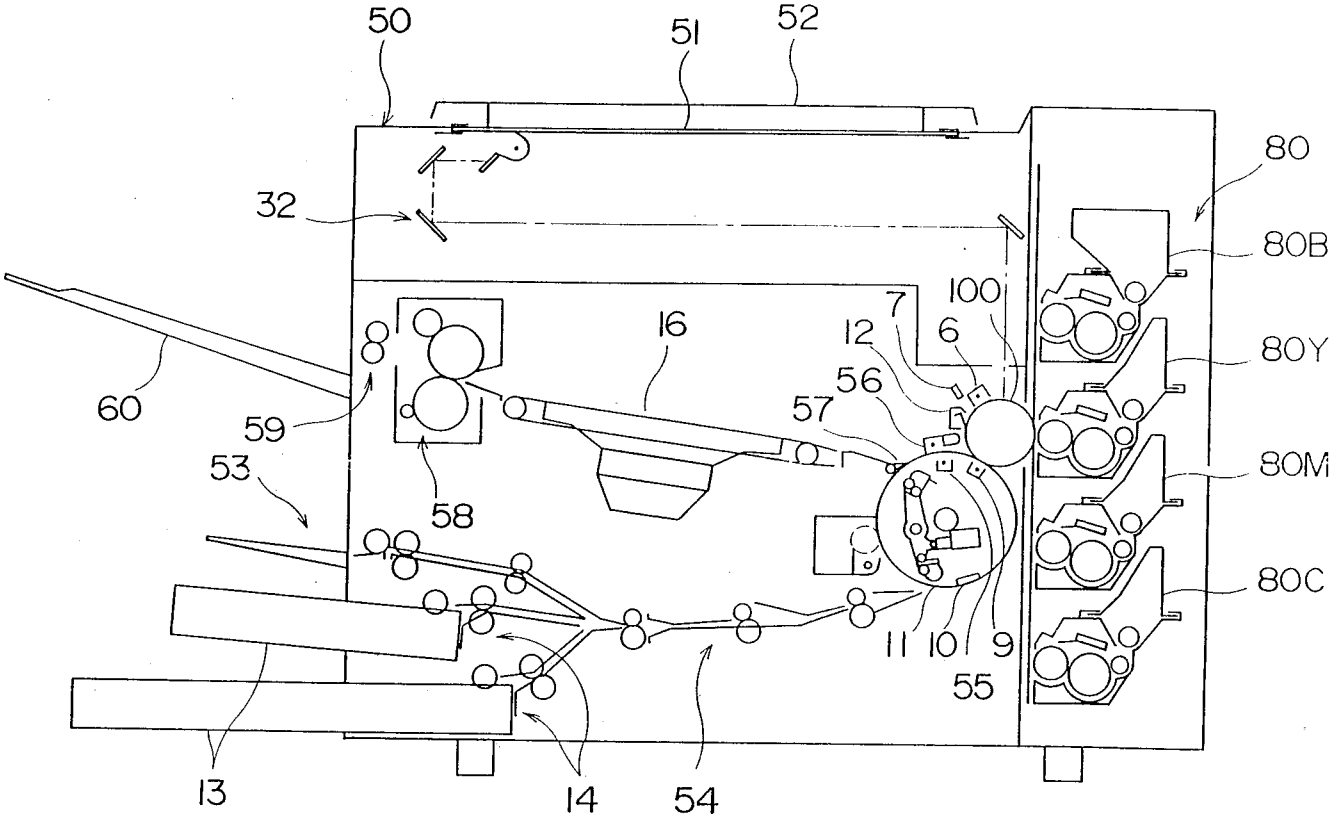
FIG. 4 is a schematic illustration representing a color image forming apparatus given in another embodiment of the invention.
Figure 5:
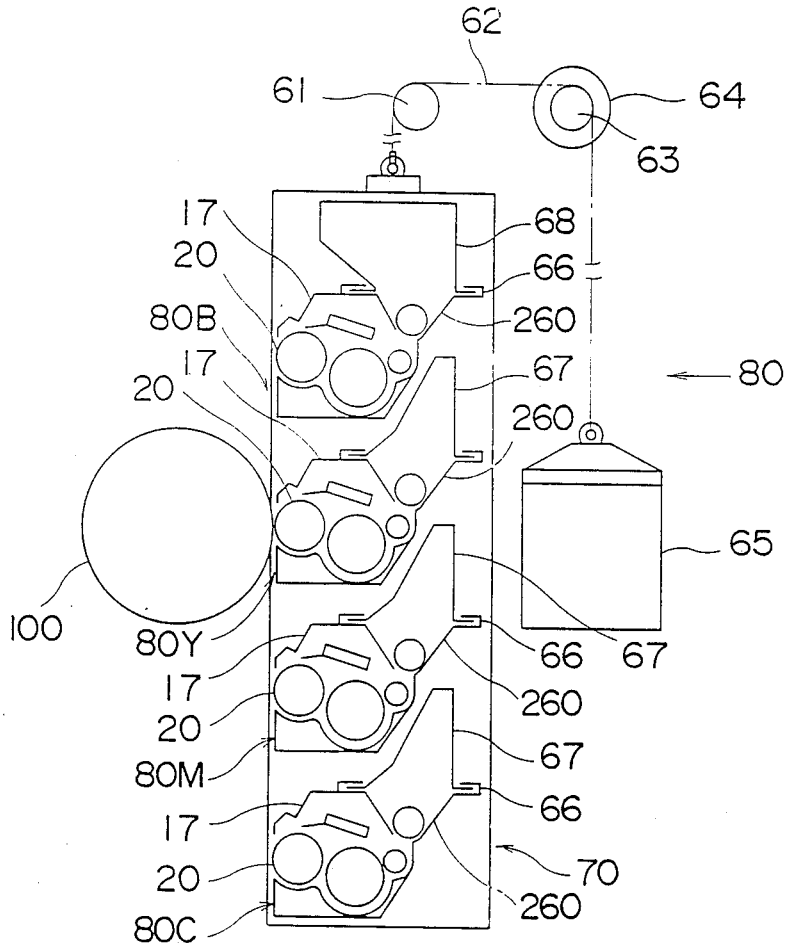
FIG. 5 is a schematic illustration representing a main part of the color image forming apparatus of FIG. 4.
Figure 6:
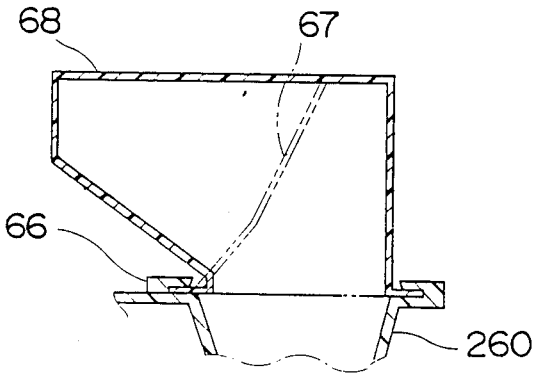
FIG. 6 is a sectional view representing a state wherein a cartridge is installed on the developer supplying mechanism of FIG. 5.

FIG. 4 to FIG. 6 represent a second embodiment of the invention. In the embodiment, like reference numerals represent like parts in the first embodiment. FIG. 4 is a schematic illustration of a color image forming apparatus, wherein a platen 51 for placing a document thereon and a document retainer cover 52 for covering the platen 51 are provided on the upper portion of a color image forming apparatus body 50. Then the optical system 32 is provided for projecting a light image of the document placed on the platen 51. The light image of the document projected by the optical system 32 is introduced to a photosensitive drum 100 provided on a right side from the center of the color image forming apparatus body 50. The main charger 6, a developing device 80 provided with developing units 80B, 80Y, 80M, 80C, the transfer drum 11, the cleaning device 12 and the discharger 7 are provided around the photosensitive drum 100 in that order in the direction of rotation. The transfer charger 9 is provided within the transfer drum 11, and the gripper 10 for holding a sheet is provided on a peripheral surface of the transfer drum 11. Then, separating chargers 55, 56 for separating the sheet from the transfer drum 11 are provided near the transfer charger 9. The feed cassette 13 for containing sheets and a hand feed tray 53 are provided on a left lower side of the color image forming apparatus body 50, and sheets may be fed selectively from either the feed cassette 13 or the hand feed tray 53. The sheet thus fed selectively is guided to the transfer drum 11 by a guide motion 54. Then the leading edge of the sheet is held on the gripper 10, and the sheet is wound round the transfer drum 11. Then an image on the photosensitive drum 100 is transferred to the sheet by the transfer charger 9. When images of all colors are transferred to the sheet, the sheet is separated from the transfer drum 11 by the separating chargers 55, 56. Then the sheet is thoroughly removed by a separating claw 57 provided close to the transfer drum 11. The feeding device 16 is provided on a downstream side in the sheet feeding direction from the transfer drum 11, and guides the sheet to a fixing device 58. The sheet fixed by the fixing device 58 is sent to an eliminating tray 60 by an eliminating roller 59.

In referring to FIG. 5, a developing device 80 is provided with four developing units 80B, 80Y, 80M, 80C, and when a cartridge to be described hereinlater is not installed, the developing units 80B, 80Y, 80M, 80C have a common size and structure. These developing units 80B, 80Y, 80M, 80C are constructed almost similarly to the developing units 8B, 8Y, 8M, 8C in the first embodiment, and a toner hopper 260 is provided on the developing case 17 having the developing roller 20 and others. The develping units 80B, 80Y, 80M, 80C are arrayed in a row vertically within a developing housing 70. Then, the developing housing 70 in which the developing units 80B, 80Y, 80M, 80C are incorporated is coupled to a balancer 65 substantially equal in weight thereto through a rope 62 laid on two rotating shafts 61, 63 provided in parallel with each other, both being balanced. A motor 64 is connected to the rotating shaft 63 through a reduction mechanism, the shaft 63 rotates by the driving force provided by motor 64, and thus either the developing housing 70 or the balancer 65 moves upward, while the other moves downward. One of the four developing units 80B, 80Y, 80M, 80C is then placed selectively in position for developing the latent image. That is, in the embodiment, the photosensitive drum 100 is provided rotatably at a fixed position, and one of the developing units 80B, 80Y, 80M, 80C, and, more particularly developing roller 20 is selectively positioned on the photosensitive drum 100.

Engaging rail members 66, 66 for installing the cartridge thereon are provided, as shown in FIG. 6, on a top portion of each toner hopper 260 of the developing units 80B, 80Y, 80M, 80C. The cartridge has two types in ordinary-sized one 67 (indicated by a two-dot chain line in FIG. 6) and larger-sized one 68 (indicated by a full line in FIG. 6), and is constructed so as to be installed selectively on the engaging members 66, 66. The larger-sized cartridge 68 is installed on a color developing unit (80B in FIG. 5) with a toner of a color most often used by that particular user. Developing unit (80B in FIG. 5) is disposed at uppermost position of the developing housing 70 because there is a space somewhat larger than in the other positions. The ordinary-sized cartridges 67 are installed on the developing units (80Y, 80M, 80C in FIG. 5) with other colored toners contained therein, and arrayed in rows at remaining positions. While not indicated, supporting members similar to the supporting members 18, 18 in the first embodiment are provided on the developing housing 70, and any developing units 80B, 80Y, 80M, 80C can be installed on any supporting members each other, needless to say, as in the case of first embodiment.

Then, in the embodiment, a construction is such that the developing device 80 is shiftable, and one of the developing units 80B, 80Y, 80M, 80C is positioned selectively to the photosensitive drum 100 provided rotatably at a fixed position. However, another construction is conceivable, for example, the developing device is provided fixedly, and the photosensitive drum is shiftable onthe contrary, thus positioning the photosensitive drum selectively to a desired developing unit. Or otherwise, the photosensitive drum and the developing device may both be shiftable. Then, in case only the developing device is shiftable, not only it may shift vertically as in the case of the second embodiment, but also it is conceivable that the developing device may be rotatable as a whole, and thus the developing unit will be placed selectively in a developing position of the photosensitive drum.

Further, in the first embodiment, the cartridge 68 shown in the second embodiment may be applied as a supplemental developer container instead of the supplemental hopper 29. On the other hand, a developing device provided with the supplemental hopper 29 as in the first embodiment may be applied, needless to say, to a color image forming apparatus wherein the latent image bearing member and the developing device are shifted relatively as in the second embodiment.

Then, in either embodiment described above, the developing units have a common size and structure each, therefore parts such as, for example, developing case or the like may be produced on the same metallic mold, and a common use of the parts may be realized accordingly. However, the developing units need not necessarily have a common size and structure, and any developing units may simply be constructed so as to be installed detachably on any supporting members each other.

Then in the above-described embodiments, a developing device provided with four-color developing units is disclosed for full-color development, however, the developing means may be provided with only two-color developing units or three-color developing units.

Further, in the above-described embodiments, the latent image bearing member is an endless belt or drum, however, a plurality of image forming means including the latent image bearing member and the developing device which coordinates with each color may be provided and faced on the transfer belt.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A color image forming apparatus, comprising:

a latent image bearing member;

means for developing a latent image which is formed on said latent image bearing member, said means including;

a plurality of developing units each having means for supplying developer, supplemental developer containing means, a plurality of supporting members each adapted to detachably mount any one of said developing units, and each of said developing units further comprising engaging means for detachably engaging said supplemental developer containing means, and said supplemental developer containing means being engaged with a predetermined one of said developing units; and said color image forming apparatus having a space formed therein and the space being positioned with respect to one of said supporting members so as to accommodate said predetermined one of said developing units with engaged supplemental developer containing means, and the remainder of said developing units, which are free from said supplemental developer containing means, being mounted on the other of said supporting members.

2. A color image forming apparatus, comprising:

a latent image bearing member;

means for developing a latent image formed on said latent image bearing member, said means for developing including a plurality of developing units and supporting members for supporting said developing units, any of said developing units being detachably mounted on any one of said supporting members, and said developing units each having means for supplying developer, wherein supplemental developer containing means is detachably connectable to each of said developer supplying means of said developing units, whereby said supplemental developer containing means is connected to one of said developing units, and said developing unit provided with said supplemental developer containing means is mounted on a predetermined one of said supporting members, and the remainder of said developing units without the supplemental developer containing means being mounted on the remainder of said supporting members, and wherein each of said developer supplying means includes means for engaging with said supplemental developer containing means and said cover being provided as part of said engaging means.

3. An apparatus according to claim 1, wherein each of said developing units further includes a cover, and said supplemental developer containing means engaging with said engaging means, when the cover is opened.

4. An apparatus according to claim 3, wherein said cover is provided with part of said engaging means.

5. An apparatus according to claim 1, wherein said supplemental developer containing means has a cover means for supplying developer therethrough.

6. An apparatus according to claim 1, wherein said supplemental developer containing means is of a cartridge-type.

7. An apparatus according to claim 1, wherein each of said developing units has a common size and structure.

8. An apparatus according to claim 1, wherein said predetermined supporting member is positioned at an end of the developing means.

9. An apparatus according to claim 1, wherein all of the developing units face said latent image bearing member, and at least one of said developing units is selectively actuated to develop the latent image.

10. An apparatus according to claim 1, wherein said latent image bearing member and said developing means are relatively moved to a position where a selected developing unit is placed in a developing position for developing the latent image.

11. An apparatus according to claim 1, wherein said plurality of developing units contain different color developers, respectively.

* * * * *